United States Patent [19]

Grange

[11] Patent Number: 4,922,609

[45] Date of Patent: May 8, 1990

[54] PIVOT HEAD RAZOR

[75] Inventor: Kenneth Grange, London, Great Britain

[73] Assignee: Wilkinson Sword Gesellschaft mit beschränkter Haftung, Solingen, Fed. Rep. of Germany

[21] Appl. No.: 284,953

[22] Filed: Dec. 15, 1988

[30] Foreign Application Priority Data

Dec. 18, 1987 [DE] Fed. Rep. of Germany ..... 3742956

[51] Int. Cl.[5] ..... B26B 21/14

[52] U.S. Cl. ..... 30/57; 30/89

[58] Field of Search ..... 30/57, 89, 87, 47–50

[56] References Cited

U.S. PATENT DOCUMENTS

| | | | |
|---|---|---|---|
| 4,083,104 | 4/1978 | Nissen et al. | 30/89 |
| 4,266,340 | 8/1981 | Bowman | 30/89 |
| 4,281,453 | 8/1981 | Dixon et al. | 30/89 |
| 4,756,082 | 7/1988 | Apprille | 30/89 |

*Primary Examiner*—Doulgas D. Watts

*Attorney, Agent, or Firm*—Robert W. Becker

[57] ABSTRACT

A pivot head razor having a prong holder that is disposed in a razor head, is adapted to be opened and closed, and serves to receive, hold, and release a pivot head razor blade. The razor head also has a spring cam that can be pressed in and that correspondingly rests against the back side of the pivot head razor blade. In order to arrest the pivot head razor blade in the prong holder in its shaving position via positive engagement of the pivot head razor blade, the spring cam is adapted to be locked by a locking device.

9 Claims, 6 Drawing Sheets

27

4
5A
5A
5B
5B

27

PIVOT HEAD RAZOR

BACKGROUND OF THE INVENTION

The present invention relates to a pivot head razor having a prong holder that is disposed in a razor head and is adapted to be opened and closed for receiving, holding, and releasing a pivot head razor blade. A spring cam that can be pressed in correspondingly rests against the pivot head razor blade to swivel the same about a neutral position and to eject the same upon release, with the pivot head razor blade being adapted to be locked in its shaving position in the prong holder, via positive engagement of the pivot head razor blade, by means of a locking device that can be actuated by a user, and that is associated with a locking element.

In the following specification and claims, the technical expression "pivot head razor blade" also includes the so-called razor blade units that have one or more razor blades that are fixedly embedded in plastic holders.

A pivot head razor of the aforementioned general type is known from published European Pat. application No. 0 271 185. With this razor, a razor blade holding mechanism is disposed between a bottom part and a separate upper part that are adjoined to form the razor head. This holding mechanism chiefly comprises a prong holder that is adapted to be opened and closed for receiving, holding, and releasing a pivot head razor blade. This razor blade is pivotably mounted in the prong holder between the two free ends thereof, which are directed toward one another, so that when shaving, the razor blade can conform to the shape of the face by swiveling movements while maintaining a favorable shaving angle. To load or eject a pivot head razor blade from the prong holder, an actuating element in the form of a slide is provided on the back side of the razor head; with this slide, the oppositely directed receiving prongs can be pivoted. A new pivot head razor blade could also be received in the open position of the prong holder, in which connection, by releasing the slide, the prongs, which are spring-loaded, return to their closed position, thereby holding the pivot head razor blade in the shaving position in such a way that the blade can be swivelled. In order to be able to hold the pivot head razor blade in its neutral position, from which it can be swivelled in both directions, a spring cam, which can be pressed in, projects from the front end face of the razor head; this spring cam correspondingly rests against the back side of the pivot head razor blade. Since the spring cam is under spring tension, when a used pivot head razor blade is released, the spring cam also acts as an ejection mechanism.

Experience has shown that not every user prefers a pivot head razor blade. In fact, almost the same number of consumers in principle use a fixed razor system. For this reason, the known pivot head razor is additionally provided with a locking mechanism via which the pivot head razor blade can be locked in the prong holder in its shaving position by a looking device that is to be actuated by the user. This locking device operates by having a looking element that positively engages the pivot head razor blade and fixes it in position. This locking element comprises a shift element that is displaceably disposed in the razor head and that, to lock the pivot head razor blade, is extended on both sides of the spring cam in such a way that its tip rests against the back side of the pivot head razor blade and fixes the same in position. A rotary knob that is mounted in the razor head serves for the displacement of the shift element. Via a cam, the rotary knob engages in a cutout in the shift element, with displacement being effected by rotating the shift element to the front or to the rear.

The drawback of this heretofore known pivot head razor is that it comprises a large number of individual parts, which results in a complicated assembly. Furthermore, so that the pivot head razor can function satisfactorily, the individual parts must fit exactly together, with even slight deviations leading to problems and therefore rejection. This is particularly true with regard to the fact that in addition to the spring cam, a separate locking element in the form of a shift element must be provided, which independently of the spring cam must be adapted to be shifted out of the razor head.

It is therefore an object of the present invention to improve the heretofore known pivot head razor in such a way that it is technically simplified, especially with regard to the locking mechanism for the pivot head razor blade.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 2:
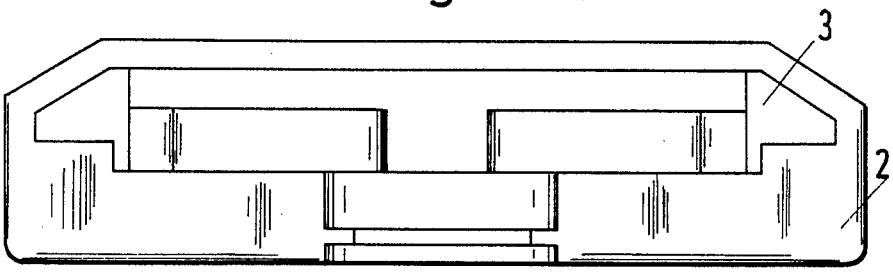
FIG. 2 is an end view of the front of the razor head without the control mechanism.
Figure 1:
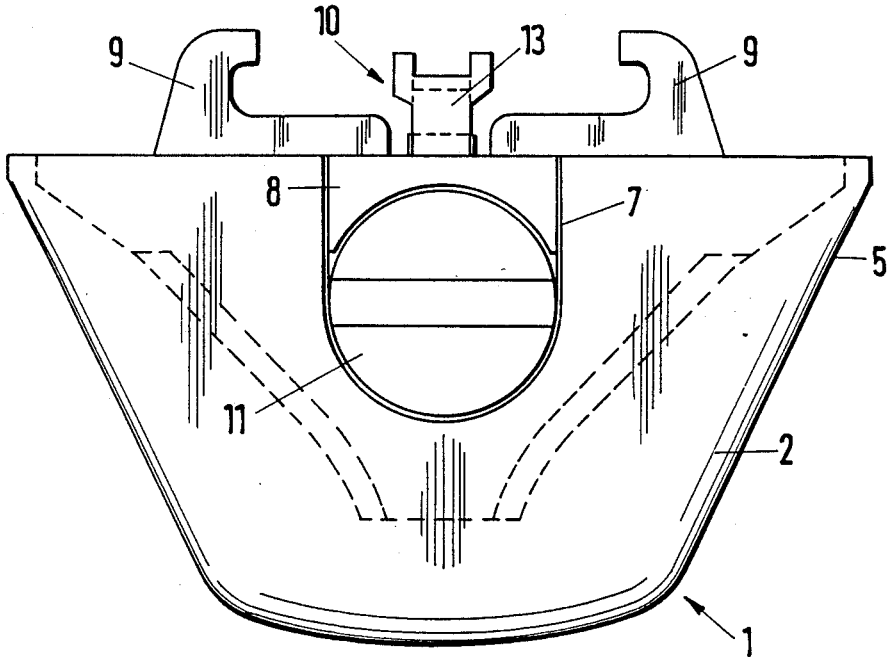
FIG. 1. is a plan view of one exemplary embodiment of the inventive razor head without the handle.
Figure 4:
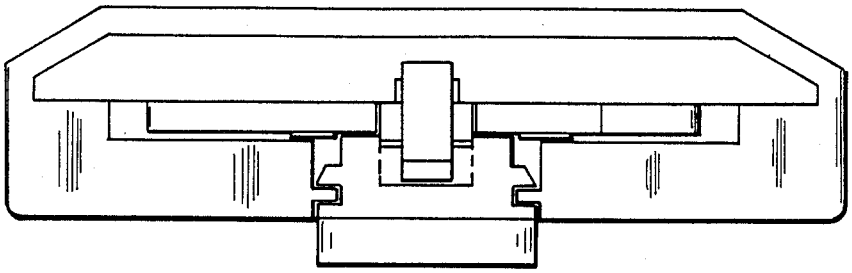
FIG. 4 is an end view of the front of the razor head with the control mechanism.

The pivot head razor of the present invention is characterized primarily in that the locking element is the spring cam and can be locked by the locking device.

By simultaneously embodying the spring cam as the locking element, a structurally more straightforward pivot head razor is provided that operates without a lot of individual parts. In this connection, the spring cam serves as a device for defining the neutral position of the pivot head razor blade for the swivel movements, and also serves as an ejection device during the release of a used pivot head razor blade; furthermore, the spring cam serves as the locking device for a fixed razor system, since the locking device pursuant to the present invention locks the spring cam with respect to its ability to shift. This results in a straightforward construction that can be mounted without difficulty within the razor head and without, due to tolerance deviations, having to fear problems that lead to rejection.

In a first specific embodiment for actuating the locking device, a pivotable lever is provided, especially on the back side of the razor head remote from the pivot head razor blade. In this way, via a manipulation with one hand, the user can convert the pivot head razor into a fixed razor system by operating the lever.

Starting with the known pivot head razor, with a slide for opening and possibly closing the prong holder, as well as with a rotary knob for actuating the locking device, it is proposed pursuant to an alternative specific embodiment of the present invention that the slide in addition be rotatable via an integrated rotary knob, and be combined with the locking device in such a way that in one rotated position of the rotary slide, which position differs from the swivel position, the pivot head razor blade be locked. This facilitates the manipulation of the pivot head razor for the user, since in the one rotated position of the rotary slide the user can receive and release the pivot head razor blade, with swiveling of the pivot head razor blade also being possible in this position. In the other rotated position of the rotary slide, the locking device then fixes the pivot head razor blade in position.

The locking device preferably has a locking means that in the arresting position fixes the spring cam in position. By means of such a looking means, a very reliable locking of the pivot head razor blade is possible. In this connection, the locking means is preferably disposed on the shaft of the lever or of the rotary slide, so that by an appropriate rotational movement the locking means reaches its operative position. In so doing, the locking means, in the arresting position, fixes at the front side the spring cam and at the back side the abutment thereof, whereby the locking means is provided with an inclined contact surface.

Pursuant to one preferred further specific embodiment of the present invention, it is proposed that the razor head be provided with an outer body that at the front has a window into which can be inserted, a separate subassembly, that includes, among other things, a razor blade holding mechanism, the prong holder, the spring cam, as well as the locking device. This subassembly can be fixed in position in the razor head, especially with a latching mechanism. In this way, a separate subassembly is provided that contains all of the parts that are necessary for the functioning of the pivot head razor, and that after separate assembly can be inserted into the razor head.

Further specific features of the present invention will be described in detail subsequently.

DESCRIPTION OF PREFERRED EMBODIMENTS

Referring now to the drawings in detail, the razor head 1 of the pivot head razor, which is not shown in its entirety, is provided with an outer body 2 having at the front a window 3 in which can be inserted the parts belonging to the actual holder of the non-illustrated razor blade unit. The outer body 2 is provided with a razor handle, which is not illustrated but can be integral with the body 2 or can be connectable thereto.

A lower base plate 4 of essentially triangular shape, and an upper cover plate 5, form, together with transverse and possibly side connectors 6, a housing. The upper cover plate 5 is provided with a wide recess 7 for receiving and guiding a slide 8 that can be pushed forward and allows the user to bring the receiving prongs 9 of a prong holder 10 into an open position for receiving the razor blade unit. The slide 8, which can be moved forward and back, is combined with a rotary knob 11 which makes it possible for the user, by turning the knob to lock in a fixed position a razor blade unit that has been received and held by the prong holder 10. For this purpose, the rotary knob 11, via a locking device 12 that is disposed below the upper cover plate 5, acts upon a spring cam 13 that is disposed between the receiving prongs 9 of the prong holder 10 and can be pressed in by a central rib of the razor blade unit that is to be inserted. The spring cam 13, in the pivot position, is spring-loaded and can be pressed in, and in the locking position, to obtain a fixed razor system, can be blocked by the locking mechanism in an abutting position against the razor blade unit after the rotary knob 11 has been appropriately turned.

Figures 5, 5A, 5B:
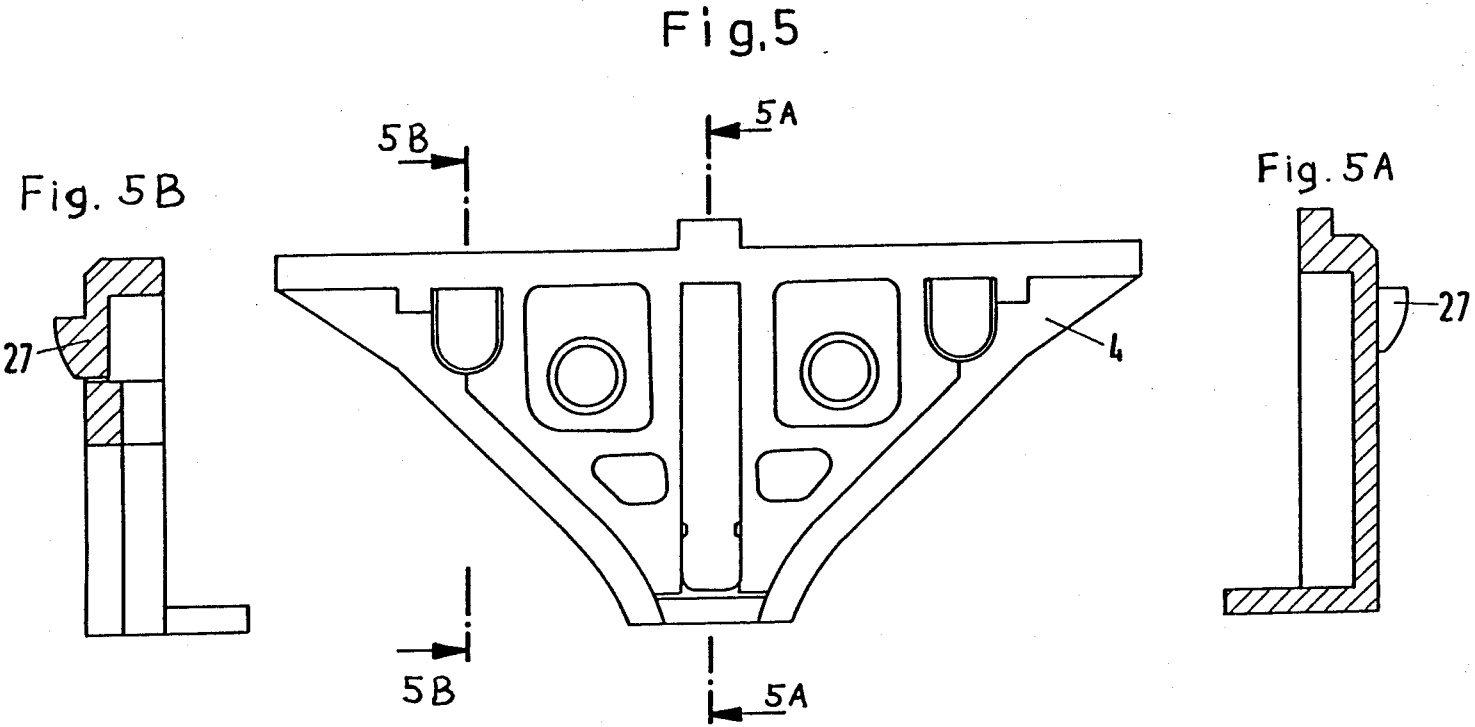
FIG. 5 is a bottom view of the razor head.
FIG. 5A is a cross-sectional view taken along the line 5A—5A of FIG. 5.
FIG. 5B cross-sectional view taken along the line 5B—5B of FIG. 5.
Figure 6:
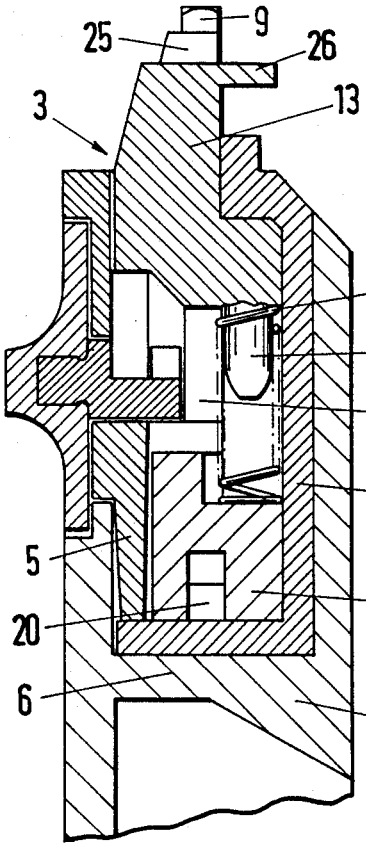
FIG. 6 is a partial cross-sectional view taken along the line 6—6 of FIG. 3 with the control mechanism in the pivot position.
Figure 7:
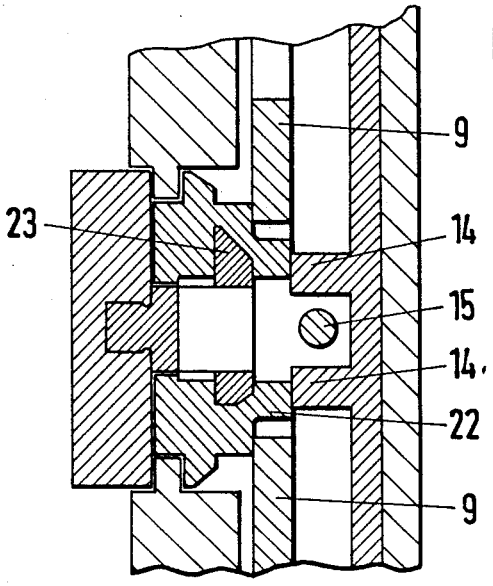
FIG. 7 is a partial cross-sectional view taken along the line 7—7 of FIG. 3.
Figure 8:
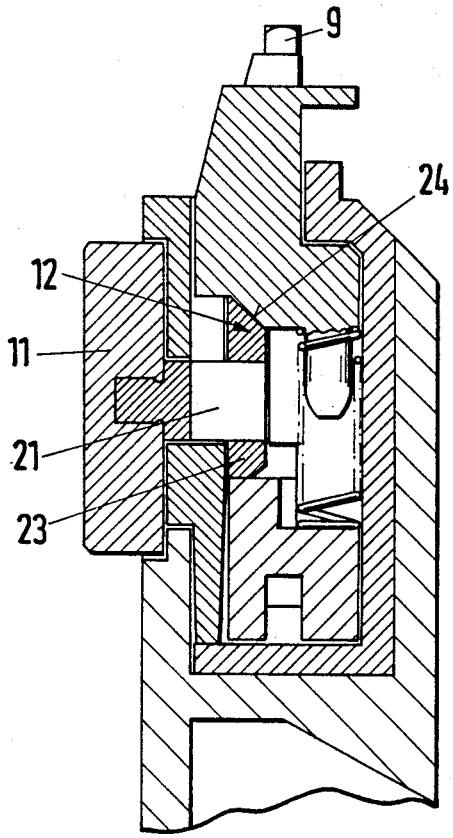
FIG. 8 is a partial cross-sectional view similar to FIG. 6 but with the control mechanism in the locked position.

The inner construction of the prefabricated razor blade holding mechanism, which is to be inserted into the outer body 2 and is to interlock therewith (for example via the latching projection 27, see FIGS. 5A and 5B), can be best seen from the cross-sectional views of FIGS. 6 to 9. As can be seen, the lower base plate 4 has an L-shaped cross-sectional configuration and forms with the upper cover plate 5 a housing for holding the rotary knob 11, which is disposed on the upper side and is combined with the slide 8. In its interior, the housing contains a holder for the receiving prongs 9, the spring cam 13, and various control parts that enable the axial displacement of the slide 8 as well as rotation of the rotary knob 11 in a direction for receiving, holding, and releasing a pivot head razor blade unit, and that also enable the razor blade unit to be locked via the locking device.

Figure 3:
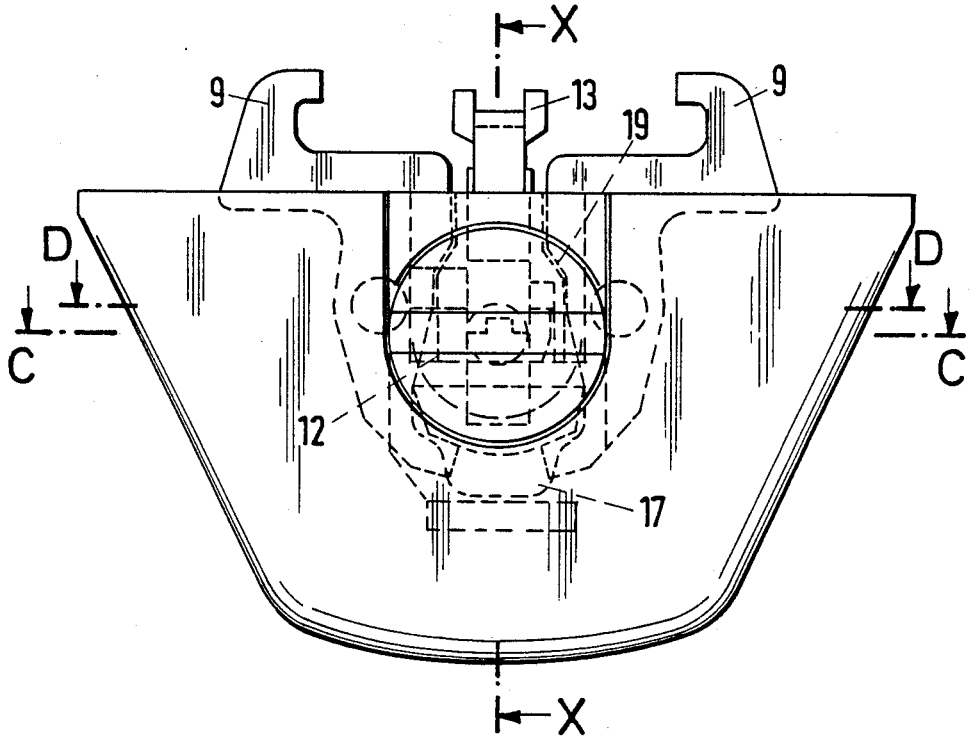
FIG. 3 plan view of the razor head with a partial view of the interior.
Figure 9:
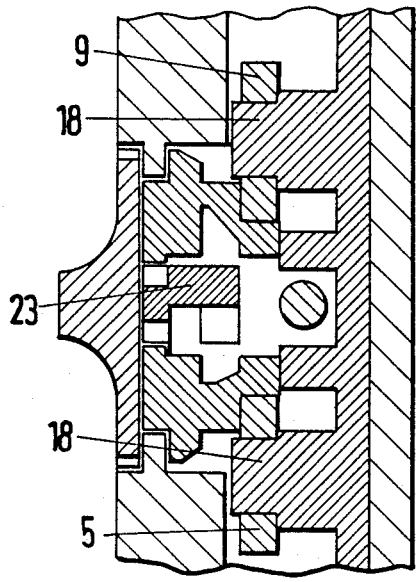
FIG. 9 is a partial cross-sectional view along the line 9—9 of FIG. 3.

Disposed on both sides of the center of the lower base plate 4, parallel to one another, are longitudinal guides 14 (FIG. 7) for the spring cam 13, the inner side of which ends in a pin 15 that is one abutment for a compression spring 16, the other abutment 17 of which is also, via the slide 8, axially movably disposed in the guides 14 at the rear end. The spring cam 13 is confined by the prong holder 10, the receiving prongs 9 of which, as can be seen from FIG. 9, are swivel-mounted on swivel support pins 18 of the lower base plate 4 in opposite directions to the side, with the inner side of each prong arm being embodied as a widening and stepped curve or cam 19, as can best be seen from the dashed-line representation in FIG. 3. Via the cam 19, the displacement movement of the slide 8 toward the front is converted into a swiveling movement of the receiving prongs 9 toward the outside into their open position.

The rear ends of the receiving prongs 9 interlock with a recess 20 of the abutment 17, so that with the axial shifting of the slide 8 to the front, and the thereby induced swiveling movement of the receiving prongs 9 to the outside, the abutment 17 is pressed forward in the longitudinal guides 14, thereby tensioning the spring 16.

To achieve swiveling of the receiving prongs 9 into their open position by shifting the slide 8 to the front, the slide 8 is axially movably held in the recess 7 of the upper cover plate 5 via a tongue and groove engagement. In this connection, the inner portion of the slide 8 confines the spring cam 13 and forms therefor a guide that enables axial movement of the spring cam to the rear counter to the effect of the compression spring 16. Provided on a central shaft 21 of the slide 8, which shaft at the same time forms the axis of rotation for the rotary knob 11, is, on the inside, a cam plate 22 that cooperates with the cam 19 of the prong holder 10 in such a way that when the slide 8 shifts axially, the prong holder 10 is opened and is held in this open position in a form-locking manner. When pressure is exerted upon the spring cam 13, which occurs automatically via the central rib of a razor blade unit that is received, the spring cam is pressed inwardly, the force is transmitted via the compression spring 16 to the rear abutment 17, and as a result of the action of this rear abutment upon the rear prong ends that are engaged in the recess 20, a closing of the prong holder 10 is effected. In so doing, the slide 8 is also moved back into its starting position.

The looking device 12 comprises the rotary knob 11, which is rotatable in the slide 8 into a locking position; disposed on the shaft 21 of the rotary knob 11 is a looking means 23. On the front side, in its fixing position illustrated in FIG. 8, the locking means 23 blocks the spring cam 13 via an inclined contact surface 24, and with its rear end presses the abutment 17 against its rear stop in the L-shaped angled-off portion of the base plate 4. This locking position is possible by turning the rotary knob 11 out of its normal position into the position illustrated in FIG. 8, where the prong holder is in its closed position, i.e. when being used holds a razor blade unit between its receiving prongs 9. In order to ensure the locking of the razor blade unit, and to make any swivel movement impossible, the front end 25, in a direction toward the base plate 4, is provided with an extension 26 that enables a positive engagement against the correspondingly flat central rib (not illustrated) of the razor blade unit, hence preventing via a positive engagement any movement of the blade unit. In contrast to FIGS. 8 and 9, FIGS. 6 and 7 show the locking device in its inoperative position with the rotary knob 11 turned by 90°, so that the customary swivel movement of the razor blade unit in the pivot head razor is possible. Due to its ability to freely move back, the spring cam 13 can move against the effect of the compression spring and does not prevent pivoting of the razor blade unit.

Figure 10:
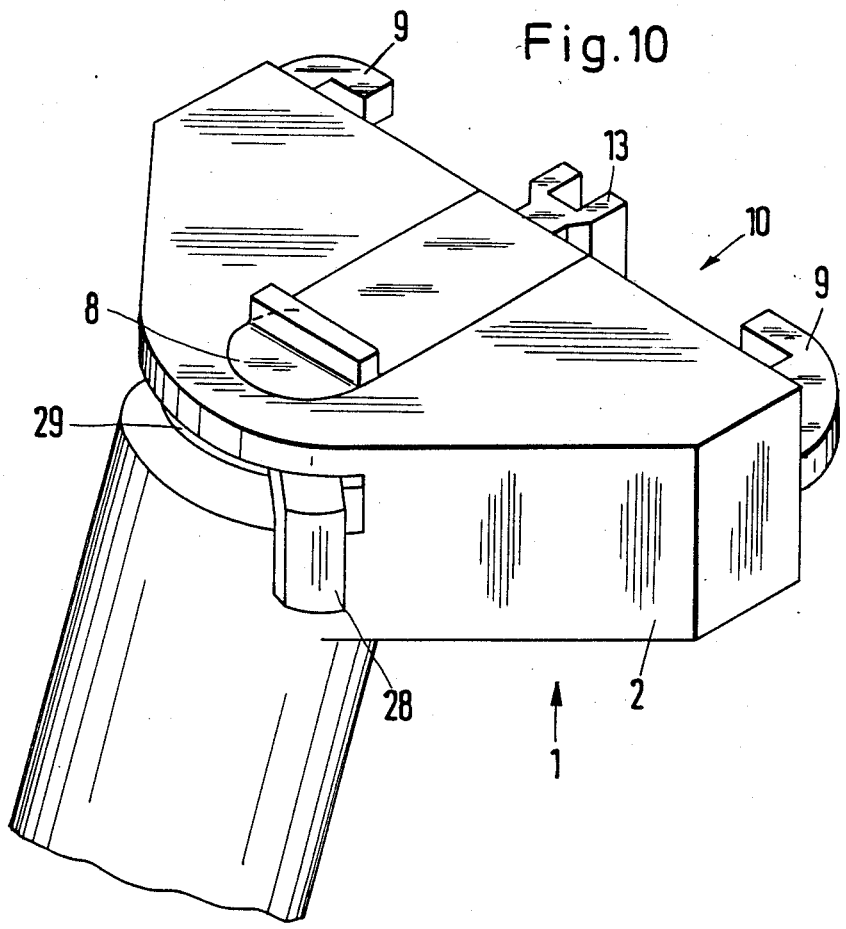
FIG. 10 is a perspective view from behind of an alternative exemplary embodiment of the inventive razor head.

The alternative embodiment of the razor head 1 illustrated in FIG. 10 differs from the previously described embodiment in that instead of a rotary knob 11 that is integrated in the slide 8, a lever 28 is provided. The lever 28 is guided out of the interior of the razor head 1 to the back side thereof through a slot 29. This embodiment, using a lever 28 to lock the spring cam 13, also provides a locking means 23 (not visible) that is disposed on the shaft 21 of the lever 28 and, during a pivoting movement, has its contact surfaces 24 engage the spring cam 13. If the lever 28 is pivoted back, the spring cam 13 is again released, so that the swivel head razor blade can again swivel in the prong holder.

The present invention is, of course, in no way restricted to the specific disclosure of the specification and drawings, but also encompasses any modifications within the scope of the appended claims.

What I claim is:

1. In a pivot head razor having a prong holder that is disposed in a razor head and is adapted to be opened and closed for receiving, holding, and releasing a pivot head razor blade, including a spring cam that can be pressed in and that correspondingly rests against said pivot head razor blade to swivel same about a neutral position and to eject same upon release, with said pivot head razor blade being adapted to be locked in its shaving position in said prong holder, via positive engagement of said pivot head razor blade, by means of a locking device that can be actuated by a user and that is associated with a locking element, the improvement wherein:

said locking element is said spring cam and can be locked by said locking device.

2. A pivot head razor according to claim 1, which includes a pivotably mounted lever for operating said locking device.

3. A pivot head razor according to claim 2, in which said lever is provided on a back side of said razor head remote from said pivot head razor blade.

4. A pivot head razor according to claim 1, which includes a rotary knob for operating said locking device, and a slide for opening and closing said prong holder, with said slide being rotatable via operative connection with said rotary knob and being combined with said looking device in such a way that said pivot head razor blade is locked in a first rotated position of said rotatable slide, which first position differs from a second rotated position thereof that permits said pivot head razor blade to swivel.

5. A pivot head razor according to claim 1, in which said looking device is provided with locking means that in an arresting position fixes the position of said spring cam.

6. A pivot head razor according to claim 5, which includes actuating means for operating said looking device, with said actuating means including a shaft on which is disposed said locking means.

7. A pivot head razor according to claim 5, which includes an abutment for said spring cam, and in which said looking means has an inclined contact surface and in an arresting position toward the front, in a direction toward said pivot head razor blade, fixes the position of said spring cam, and toward the rear fixes the position of said abutment.

8. A pivot head razor according to claim 1, in which said razor head has an outer body with a window toward the front into which can be inserted a separate subassembly that includes, among other things, a razor blade holding mechanism, said prong holder, said spring cam, and said locking device, with said subassembly being adapted to be fixed in position in said razor head.

9. A pivot head razor according to claim 8, which includes latching means for fixing the position of said subassembly in said razor head.

* * * * *